United States Patent [19]

Hutchins

[11] Patent Number: 4,660,329

[45] Date of Patent: Apr. 28, 1987

[54] POWERED ABRADING TOOL

[75] Inventor: Alma A. Hutchins, Pasadena, Calif.

[73] Assignee: Hutchins Manufacturing Company, Pasadena, Calif.

[21] Appl. No.: 198,789

[22] Filed: Oct. 20, 1980

[51] Int. Cl.[4] ..... B24B 23/00

[52] U.S. Cl. ..... 51/170 MT; 51/273; 403/356; 403/357

[58] Field of Search ..... 51/170 MT, 170 T, 170 R, 51/273; 403/356, 358, 357

[56] References Cited

U.S. PATENT DOCUMENTS

| | | | |
|---|---|---|---|
| 1,115,276 | 10/1914 | Blondo | 403/356 |
| 1,623,520 | 4/1927 | Bennington | 51/170 T |
| 2,334,172 | 11/1943 | Champayne | 51/170 MT |
| 3,084,364 | 4/1963 | Hutchins . | |
| 3,364,625 | 1/1968 | Sogge | 51/170 R |
| 3,496,680 | 2/1970 | Hutchins . | |
| 3,639,090 | 2/1972 | Hutchins . | |
| 3,755,972 | 9/1973 | Mogaki et al. | 51/170 MT |
| 3,815,292 | 6/1974 | Hutchins | 51/170 MT |
| 3,824,745 | 7/1974 | Hutchins | 51/170 T |
| 3,899,852 | 8/1975 | Batson | 51/170 T |
| 4,145,848 | 3/1979 | Hutchins | 51/170 T |

FOREIGN PATENT DOCUMENTS

| | | | |
|---|---|---|---|
| 1078618 | 6/1980 | Canada | 51/170 T |
| 2255999 | 7/1975 | France | 51/170 TL |
| 300308 | 9/1932 | Italy | 51/170 T |
| 6195 | 1/1977 | Japan | 51/170 T |

OTHER PUBLICATIONS

"High Performance Pneumatic Finishing Sanders", Hutchins Manufacturing Company, Cat. No. H76 100MTC.

*Primary Examiner*—Roscoe V. Parker
*Attorney, Agent, or Firm*—William P. Green

[57] ABSTRACT

A portable abrading or polishing tool including a motor which drives orbitally a head carrying a working pad to which sandpaper or the like may be attached, with the motor of the device driving a carrier about a first axis, and with the carrier mounting the head to turn relative thereto about a second axis. The head and carrier are connected together by bearings, preferably including a large bearing near the head and a smaller bearing offset toward the motor. A counterweight structure is connected to the carrier and located near the axially outer end of the bearings for close coupling with the head and reduction of vibration in use. Fasteners attaching the counterweight to the carrier may serve a secondary purpose of forceably pulling the head and bearings from the carrier during disassembly. An elastomeric handle extending over the motor prevents transmission of low temperatures to a user's hand, and cushions engagement with the motor. The elastomeric handle and an upper portion of a shroud are desirably of generally polygonal, preferably square, horizontal section for best engagement with a user's hand. The pad carrying head may be held against rotation during removal of the pad by a tool extending through an opening in the shroud into engagement with an irregularity formed on the head. A key for retaining the shaft and rotor of the motor against relative rotation is spring urged radially to take up play between the parts.

23 Claims, 9 Drawing Figures

64
64a
64b
64c
61
161
66
67
56
68
82
133
132
12
109
110
135
134
130
34
99
120
98
96
101
102
106
97
116
111
117
103
105
104
30
31
220
114
113
115
100
116
25
29
30
32
27
41
43
42
40
38
34
28
33
87
80
24
26
73
86
71
75
74
50
21
23
18
19
72
22
57
131
125
128
126
57
129
127
108
11
15
4
4
208
209
107
100

POWERED ABRADING TOOL

BACKGROUND OF THE INVENTION

This invention relates to improved power driven tools for abrading or polishing a work surface.

Power driven sanders or polishers have been devised in the past in which a working pad or shoe is driven orbitally relative to a handle body by which the tool is held. For example, in U.S. Pat. No. 3,084,364 issued Apr. 9, 1963, a device is shown in which a carrier part is driven rotatably about a first axis by a motor, and a working pad is connected to that carrier by bearings for rotation relative thereto about a second axis offset from the first axis, to give the pad the desired orbital movement as the motor turns. Another of the numerous orbital tools previously devised is shown in U.S. Pat. No. 3,496,680 issued Feb. 24, 1970.

SUMMARY OF THE INVENTION

A major purpose of the present invention is to provide improved orbital type power sander or polisher of the above discussed general character, which is so constructed as to greatly reduce the vibration of the tool in use as compared with prior expedients while at the same time accomplishing an extremely effective abrading or polishing operation on a work piece. In addition, a tool embodying the invention is of very rugged construction to withstand extended use without the necessity for repair, and is structurally very simple, easily assembled and disassembled, and smaller than most prior tools of a corresponding work capacity. Additionally contemplated is a tool having a handle especially constructed to be easily and effectively grasped by persons having hands of different sizes, and constructed to avoid the discomfort ordinarily encountered in a pnuematic tool as a result of the extremely low temperatures to which the device may be cooled by expansion of the compressed air which drives the tool.

A major factor in reducing vibration of the tool in use is the unique positioning of a counterweight relative to the rest of the moving parts for counterbalancing the offset relationship of the mass of the driven head and pad relative to the main rotary carrier and motor. More particularly, the counterweight is preferably so located as to be nearer to an axially outer end of the bearing means which connect the orbiting head to the rotary carrier than to an axially inner end of those bearing means, with the result that the counterweight is in a plane very close to that of the orbiting head and pad, and by virtue of this closely coupled relation the vibrational effects normally resultant from the orbital type movement are minimized. The counterweight preferably is located axially between the rotary carrier and a flange formed on the orbitally movable head. The counterweight also desirably serves the function of retaining the mentioned bearing means against detachment from the rotary carrier, and preferably within a recess in the carrier. A threaded fastener or fasteners may attach the counterweight to the carrier, and may serve a secondary function upon detachment from the carrier of forceably pulling the orbitally movable head away from the carrier. That head may be attached to the bearing means in a relation acting by such movement to also pull the bearing means from the carrier.

To enhance the control which the user has over the positioning and movement of the tool, the device is preferably provided with a handle portion which is of generally polygonal and desirably generally square horizontal section, to provide corners assisting in maintaining the handle in a fixed position relative to the hand of a user. These corners may be rounded, and the peripheral edge of the handle may be rounded as viewed in vertical section, all in a manner optimizing the gripping effect. The peripheral edge of an upper portion of the handle may project laterally beyond a portion of the handle therebeneath, so that a user's fingers may extend about that edge. A shroud extending downwardly beneath the handle may have an upper generally polygonal and preferably square portion similar to the handle for engagement with the lower portions of a user's fingers.

The handle of the device may be formed of a body of elastomeric material, desirably neoprene, which is resiliently deformable to enhance the gripping contact with the handle, and has a lower heat conductivity than that of at least a portion of the motor or main body of the device therebeneath. The elastomeric material may extend across the top of the motor and downwardly essentially about its opposite sides, with a valve actuating handle being located above the top wall of the elastomeric body.

A further feature of the invention resides in the provision of a unique key arrangement, in which a key for retaining a rotor of the pnuematic motor and a shaft extending therethrough against relative rotation is spring pressed radially to take up play between the parts and prevent wear of the parts as a result of such play.

The pad carrying head of the device may be held against rotation during removal of the head therefrom by a tool which extends through an opening in the shroud of the device to contact an irregularity on the head and hold it against rotation.

BRIEF DESCRIPTION OF THE DRAWINGS

The above and other features and objects of the invention will be better understood from the following detailed description of the typical embodiment illustrated in the accompanying drawings, in which.

DESCRIPTION OF THE PREFERRED EMBODIMENT

Figure 1:
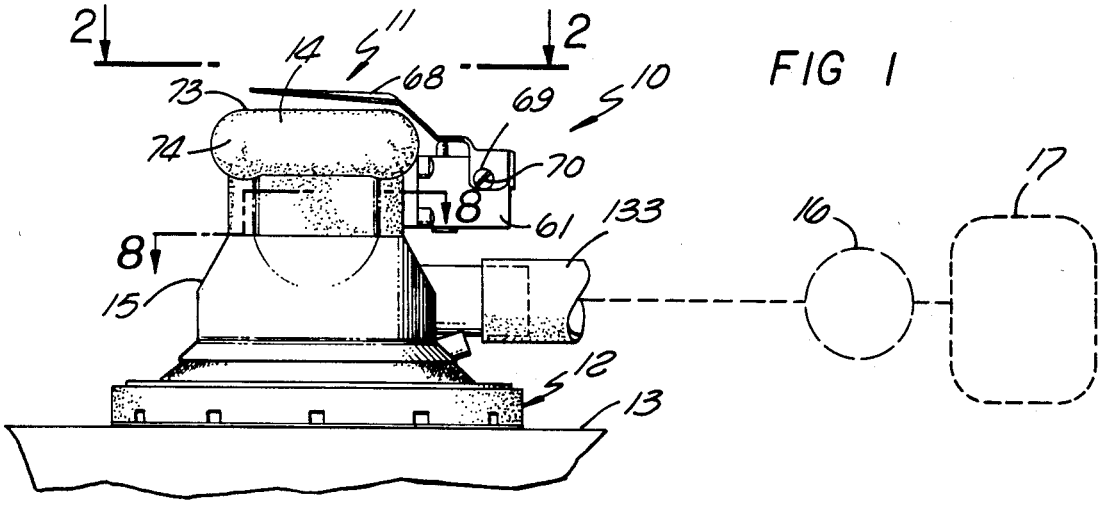
FIG. 1 is a side elevational view of a power sander constructed in accordance with the invention.

The orbital sander illustrated at 10 in FIG. 1 includes a main section 11 which is held in the hand of a user and a working pad 12 which is driven orbitally relative to a work surface 13 to abrade or polish that surface. Section 11 has an upper handle element 14 by which the tool is held by a user, and a shroud 15 at the upper or back side of pad 12 defining a compartment within which a suction unit 16 maintains a vacuum to draw particles abraded from the surface 13 into a collection bag 17.

Figure 3:
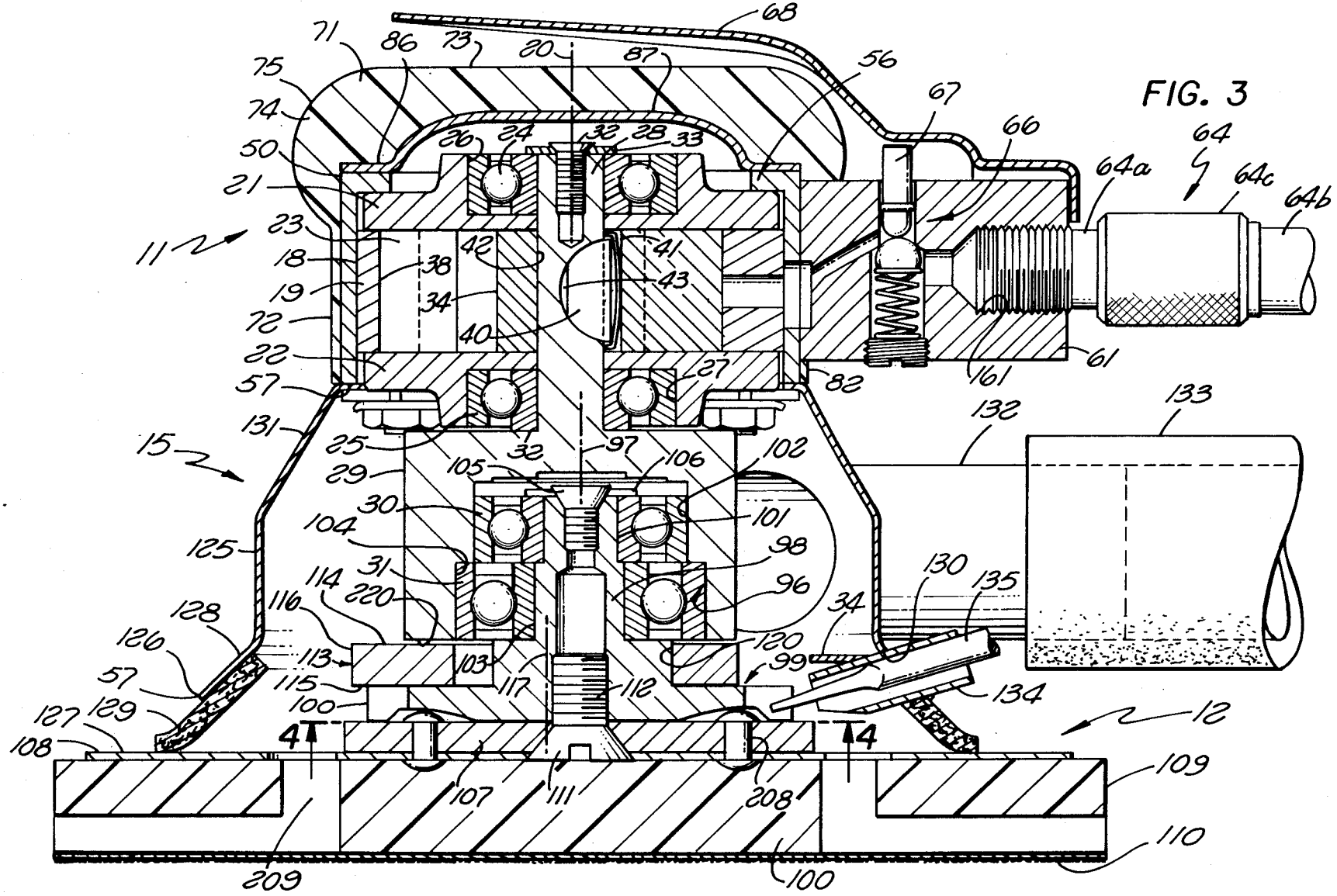
FIG. 3 is an enlarged vertical front to rear section taken on line 3—3 of FIG. 2.

As seen in FIG. 3, the main section 11 of the device contains a pnuematically driven motor 18 which may include a vertical cylindrical side wall 19 centered about a main axis 20 of the motor, and two horizontal circular top and bottom walls 21 and 22 extending across and closing the top and bottom respectively of the cylindrical motor chamber 23. Sealed ball bearings 24 and 25 are pressed fits within circular openings 26 and 27 in walls 21 and 22, and journal a vertical externally cylindrical shaft 28 for rotary movement relative to elements 19, 21 and 22.

Shaft 28 is formed integrally with an enlargement 29 which functions as a carrier for the bearings 30 and 31 which mount the working pad 12. This carrier 29 may be externally cylindrical about axis 20, and has an upper horizontal surface 32 against which the inner race of bearing 25 may bear downwardly. The motor parts are clamped in position on the shaft by a screw 32 connected threadedly into the center of the upper end of the shaft, and acting to tighten a washer 33 against the inner race of bearing 24 so that carrier 29 is fixed axially relative to the motor.

Figure 8:
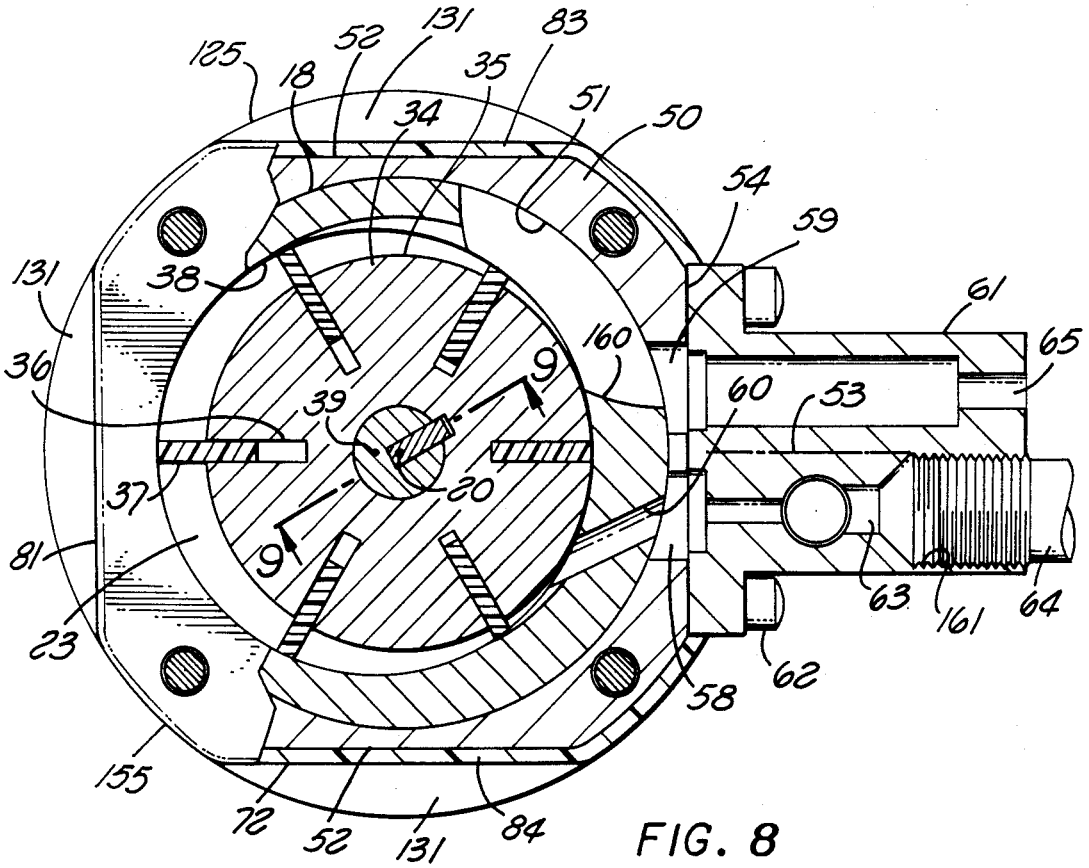
FIG. 8 is a horizontal section taken on line 8—8 of FIG. 1.

Within motor chamber 23, there is provided about shaft 28 a rotor 34, having an outer cylindrical surface 35 centered about axis 20 (see FIG. 8), and containing a series of circularly spaced axially extending radial slots 36 within which radially movable vanes 37 are received. The innersurface 38 of side wall 19 of the motor is cylindrical about a vertical axis 39 which is parallel to but offset laterally from main axis 20, to give the motor chamber 23 an eccentric configuration with respect to axis 20, so that the chambers defined circularly between successive vanes 37 progressively change in volume as they rotate, and so that air introduced into chamber 23 through an inlet 40 causes rotation of rotor 34 about axis 20. The vanes are of course so shaped as to form seals between the circularly successive compartments defined by the vanes.

Figure 9:
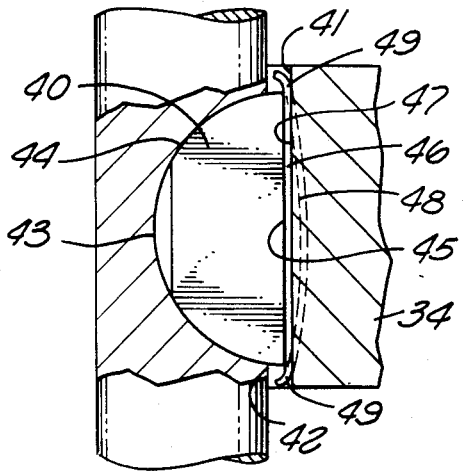
FIG. 9 is an enlarged fragmentary vertical section taken on line 9—9 of FIG. 8.

The rotor 34 is keyed rotatively to shaft 28 by a conventional woodruff key 40 received partially within an axially extending groove 41 formed in the inner cylindrical surface 42 of rotor 34 and partially within an opposed axially extending groove 43 formed in the outer surface of shaft 28. The radially inner side of key 40 may be curved arcuately as seen at 44 in FIG. 9, while the opposite radially outer surface 45 may be planar and extend directly axially. In accordance with the present invention a leaf spring element 46 is interposed radially between key 40 and the radially inwardly facing wall 47 of groove 41, to urge the key radially inwardly and take up play between the parts. This spring 46 has an axially elongated portion 48 normally tending by its resilience to return to the outwardly bowed condition illustrated in broken lines in FIG. 9. At the opposite ends of this portion 48, the spring has two radially inwardly turned extremities 49 which are received at and engage opposite ends of the key, to locate the spring axially relative to the key. When the parts are forced together with the spring in its illustrated position relative to the key and grooves, the portion 48 of the spring is forced radially inwardly to a straighter condition as seen in full lines in FIG. 9, in which it exerts a substantial force radially outwardly against rotor 34 and radially inwardly against the shaft, to hold them in firmly fixed relative positions preventing movement of the rotor relative to the shaft and thus preventing the wear which results from such movement.

Extending about the motor 18, there is provided a part 50 (FIG. 8) having an inner cylindrical surface 51 which is a close fit about motor parts 18, 21 and 22, and having an outer polygonal and preferably essentially square horizontal section. More particularly, part 50 may have two parallel planar vertical opposite sides surfaces 52 extending parallel to a front to rear plane 53 of the device, and two parallel planar vertical rear and front surfaces 54 and 55 extending perpendicular to the plane 53 and to surfaces 52. At its corners, the part 50 may have slightly curved corner surfaces 155. The part 50 has an upper radially inwardly turned annular horizontal flange 56 against which top wall 21 of the motor assembly is engageable upwardly, and has a horizontal bottom edge surface 57 approximately aligned horizontally with the undersurface of bottom wall 22 of the motor. The rear wall 54 of part 50 contains two openings 58 and 59, communicating with inlet and outlet openings 60 and 160 respectively in the side wall of the motor to introduce air into and discharge it from the motor. A block 61 is attached to the rear wall 54 of part 50 by screws 62, and contains an inlet passage 63 through which air flows from a supply line 64 into the motor chamber and a discharge passage 65 through which the air discharges from the motor. The air is admitted to the motor under the control of a manually actuated spring pressed ball valve 66 (FIG. 3), whose actuating stem 67 is operated by a manually depressable handle 68 connected to block 61 by screws 69 (FIG. 1) for pivotal movement about a horizontal axis 70. This handle 68 is received above the main handle 14 of the tool, and is pressed downwardly by a user's palm as he grasps handle 14. Such depression of handle 68 acts to open valve 66 and admit air to the motor in a manner commencing its rotation.

The handle part 14 is formed of an elastomeric material adapted to deform when a user grasps handle 14 in order to enhance the control which the user has over the device. The elastomeric material of the part 14 also has a heat conductivity which is much lower than that of the various parts of the motor, including stator parts 18, 21 and 22, and rotor parts 34, 28 and 29, as well as the part 50 disposed about the motor. All of these motor parts and element 50 are desirably formed of a highly heat conductive metal, such as aluminum or steel. The elastomeric material of handle cover 14 may be neoprene, typically having a shore hardness between about 40 and 45 on the A scale.

Figure 2:
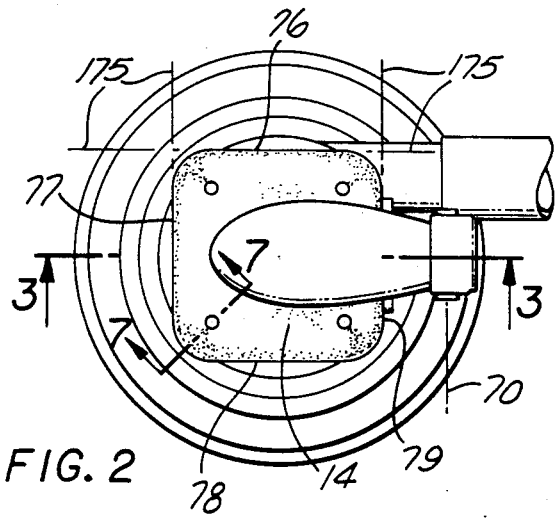
FIG. 2 is a plan view taken on line 2—2 of FIG. 1.
Figure 4:
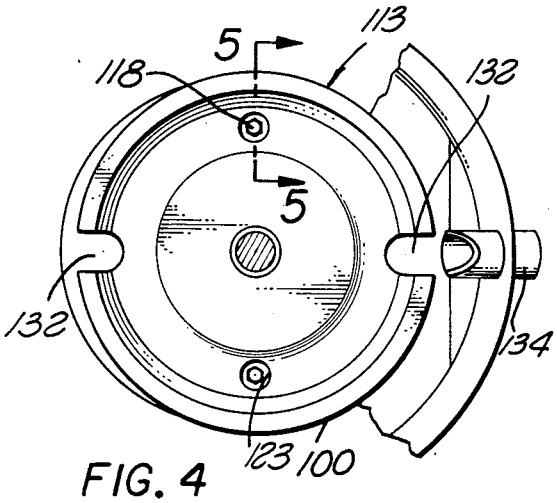
FIG. 4 is a bottom view of the orbiting head taken on line 4—4 of FIG. 3.
Figure 5:
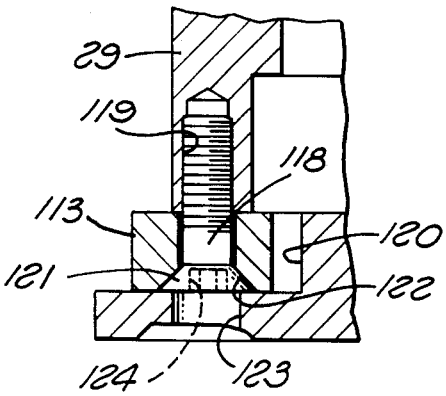
FIG. 5 is an enlarged fragmentary vertical section taken on line 5—5 of FIG. 4.

Referring again to FIG. 3, the handle cover part 14 fits about body part 50, and in particular has a top wall 71 extending across the top of the motor and part 50, and peripheral side walls 72 extending downwardly at the different sides of the externally rectangular part 50. The upper surface 73 of part 14 may be directly horizontal and perpendicular to axis 20. Along its edge, the top wall of part 14 forms an outwardly projecting edge portion 74 with an outer surface 75 which along the entire periphery of the part 14 except at the location of block 61 may have the outwardly rounded convex vertical section configuration illustrated in the left portion of FIG. 3. This configuration is partially interrupted at the location of block 61, as seen in the right portion of FIG. 3. The peripheral portion 74 of part 14 has the approximately square plan view configuration and horizontal sectional configuration illustrated in FIG. 2, with the outermost portions 76, 77, 78 and 79 surface 75 lying in vertical planes 175 which are parallel to but spaced just slightly outwardly from the planes of surfaces 52, 54 and 55 of part 50. The part 14 thus has a square configuration corresponding essentially to but slightly larger than the outer configuration of part 50, to be receivable thereabout.

Beneath surface 75, part 14 has a skirt portion 80, extending along the outer surfaces 52, 54 and 55 of part 50, and thus giving to the lower portion of part 14 a square configuration corresponding to part 50 but with the outer surfaces 81 of skirt 80 recessed inwardly relative to the upper peripheral portion 74 of part 14, to enable easy grasping of that edge portion 74. The rear wall of skirt 80 is cut away for extension of block 61 therethrough, and preferably forms a strap 82 extending across the underside of the block to hold the opposite side walls 83 and 84 against the sides of part 50. At the corners, the peripheral wall 80 may have portions 85 following the previously discussed corner configuration of the outer surface of part 50.

Figure 7:
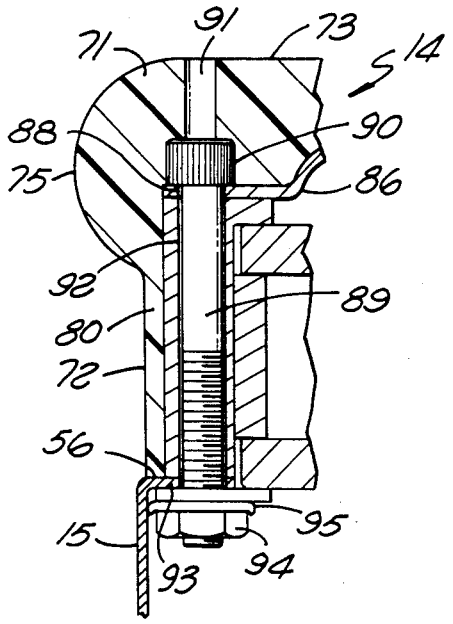
FIG. 7 is a fragmentary vertical section taken on line 7—7 of FIG. 2.

At the underside of top wall 71 of rubber part 14, there is provided a stiffening or reinforcing element 86, preferably taking the form of a stamped metal plate having greater rigidity than the soft rubber of part 14, and bonded thereto. Part 86 may have a central upwardly domed circular portion 87, and may be of an essentially square peripheral configuration corresponding essentially to but somewhat smaller in horizontal dimension than the top wall 71 of part 14. At its corners, reinforcing plate 86 contains four openings 88 (FIG. 7) through which screws 89 extend downwardly, with the heads 90 of the screws bearing downwardly against the plate to hold the plate and part 14 in place. Openings 91 in the top wall of the elastomeric body 14 allow the screws to be forced downwardly therethrough and allow access of a tool to the screws. The screws 89 extend downwardly through registering openings in a radially inwardly turned flange 93 of shroud 15, with nuts 94 and lock washers 95 being connected onto the screws at their lower ends to clamp the parts tightly vertically together.

Carrier 29 contains a recess 96 at its underside (FIG. 3) which opens downwardly or axially outwardly away from the motor. This recess is centered about an eccentric axis 97 which is parallel to but offset slightly from main axis 20 of the motor. The two bearings 30 and 31 are contained within recess 96, and are centered about the eccentric axis 97. Each of these bearings is a ball bearing, having a series of circularly spaced balls between radially inner and outer races. The upper bearing 30 is internally and externally smaller in diameter than the lower bearing 31.

The two bearings journal rotatively the shank 98 of an orbitally driven head 99 of the tool, which head has a circular flange 100 at its axially outer end extending transversely of eccentric axis 97. The upper or axially inner bearing 30 has its inner race in engagement with a reduced diameter external cylindrical surface 101 of shank 98, and its outer race in engagement with a reduced diameter internal cylindrical surface 102 in carrier 29. The larger axially outer bearing 31 has its inner race in engagement with a larger diameter cylindrical surface 103 on shank 98 and its outer race in engagement with an enlarged diameter internal surface 104 in carrier 29. A screw 105 connected into the upper end of shank 98 tightens a lock washer 106 downwardly against the inner race of upper bearing 30 to retain the bearings on the shank. The working pad 12 is detachably secured to flange 100 of head 99, and may include a rigid rear disc 107, a circular metal rigid backing plate 108, secured to disc 107 by rivets 208, and a rubber body 109 adhered to plate 108 and to the underside of which a sheet of sandpaper 110 or the like is connectable. An externally threaded stud 111 secured to parts 107 and 108 by confinement of its head therebetween projects upwardly from the center of pad 12, and is connectable into a mating threaded recess 112 formed in the center of head 99. Passages 209 extending through the rubber and metal of pad 12 enable abraded particles to be drawn by suction upwardly through those passages to the top of the pad and into the vacuum chamber defined by and within the shroud.

Vertically between flange 100 of head 99 and carrier 29 there is provided a counterweight part 113, which may have upper and lower planar horizontal surfaces 114 and 115 and an outer circular edge surface 116 centered about an axis 117 which is offset from axis 20 in a direction the opposite of the direction of offset of axis 97 relative to axis 20. Counterweight 113 may be formed of metal, such as steel, and is dimensioned and constructed to at least partially counterbalance the eccentricity of head 99 and pad 12 with respect to the main rotary axis 20. Preferably, the counterweight exactly counterbalances the head and pad, to give the overall carrier 29 and all of its connected parts substantially complete and exact balance with respect to axis 20.

Figure 6:
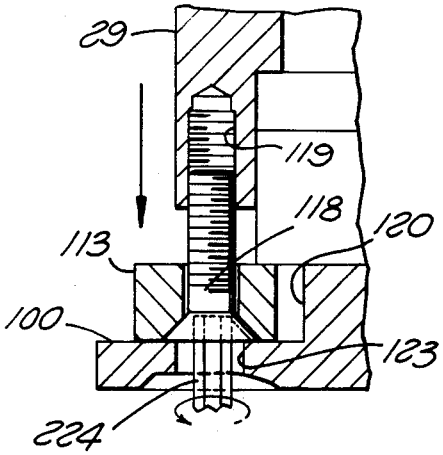
FIG. 6 is a view similar to FIG. 5 but showing the head pulled partially away from the carrier part.

The counterweight 113 is connected to the underside of carrier 29 for rotation therewith, by a number of screws 118, which extend upwardly through openings in the counterweight and into threaded bores 119 in the carrier. The counterweight 113 contains an opening 120 through which shank 98 projects upwardly into the bearings. The diameter of opening 120 is less than the external diameter of bearing 31, so that the inner edge portion of the counterweight engages upwardly against the outer race of bearing 31, to tightly clamp the bearings upwardly in their retained positions within carrier 29. In this clamping condition, the upper surface 114 of the counterweight preferably is spaced very slightly from the horizontal undersurface 220 of carrier 29. The heads 121 of screws 119 are receivable within recesses 122 in the counterweight, and are accessible through registering openings 123 formed in flange 100 to allow access of a tool to heads 121. The screws 119 may be of a type adapted for actuation by allen wrenches, containing allen wrench recesses 124 so that such a wrench 224 (FIG. 6) can extend through openings 123 into engagement with the two screws to turn those screws through the flanges. The openings 123 are smaller than heads 121 of screws 119, so that when the screws 119 are turned in a lefthand or unscrewing direction the undersurfaces of the screw heads bear against flange 100 to force it downwardly or axially outwardly relative to carrier 29, as represented in FIG. 6. This downward withdrawal of head 99 acts to forceably pull the bearings 30 and 31 from within recess 96, to thus assist in disassembly of the parts.

Shroud 15 may be stamped from sheet metal to the illustrated configuration, and more particularly may be shaped to have an approximately annular side wall 125 extending downwardly between the previously mentioned upper flange 93 and a lower annular edge 126 of the shroud. This edge 126 is received in closely spaced relation to the upper horizontal surface 127 of head 12 in the assembled condition of the tool. The portion 128 of the flange just above its lower peripheral edge 126 flares progressively to an increased diameter as it advances downwardly, and desirably is substantially conical as shown. An annular seal element 129 is carried by this lower conical edge portion 128 of the shroud, and may be formed of a relatively thin sheet like material shaped to a conical downwardly flaring configuration corresponding to portion 128 of the shroud. This seal element 129 is formed of a deformable material, preferably having resilience, and projects downwardly beyond edge 126 of the shroud and into direct contact with surface 127 to form a seal therewith. The lower annular edge of element 129 is deformed slightly from a true conical configuration by engagement with surface 127, and tends by its resilience to return to that true conical configuration in a manner bearing tightly against surface 127 in annularly sealed relation. The outer surface of part 129 above edge 126 is cemented or otherwise secured annularly to and against the inner flaring surface of portion 128 of the shroud. Seal element 129 is in the presently preferred arrangement formed of a resilient felt material, preferably wool felt.

The upper portion of sidewall 125 of shroud 18 is deformed to give it an approximately square configuration corresponding essentially to the shape of the outer surface of lower square portion 80 of rubber handle part 14. For this purpose, the material of side wall 125 is deformed to have four portions 131 at its four sides which advance relatively rapidly outwardly as they advance downwardly so that at the upper extremities of these portions 131 the flange has the desired essentially square horizontal cross-sectional configuration and at the lower extremities of these portions 131 the shroud is of circular horizontal section. Except as interrupted by these portions 131, the side wall 125 of shroud 18 is annular about axis 20, and is approximately cylindrical about that axis vertically between the flaring lower edge and upper inwardly turned flange 93 of the shroud. This approximately cylindrical side wall may reduce slightly in diameter as it advances upwardly, and just beneath the location of flange 93 is preferably of an external diameter corresponding to the outer surfaces of corner portions 85 of rubber skirt 80. The upper edges of portions 131 of the shroud are aligned vertically with the outer surfaces of skirt 80 between the corner locations, so that portions 131 merge with and form in effect lower continuations of those surfaces.

In order to exhaust the air and particles from within the shroud, a tube 132 is connected into the side wall of the shroud and rigidly secured thereto for attachment to a hose 133 leading to the vacuum unit 16.

An opening 130 is formed in the lower portion of the shroud, desirably near the back of the tool and close to tube 132, with a small tube 134 extending through that opening and being rigidly secured to the side wall 125 of the shroud and braced with respect thereto by a bracing plate 234 welded to the shroud. This tube 134 is of a size to allow extension of a screw driver 135 through the tube and to a location in which the inner extremity of the screw driver is receivable within either of two notches 123 formed in the periphery of the otherwise externally circular flange 100 of head 99. The screwdriver or other tool when thus inserted into one of the notches 123 will retain head 99 against rotation while a user manually turns pad 12 to unscrew it from the head.

Tube 134 is desirably located approximately directly beneath the internally threaded air inlet opening 161 in block 61, and in a relation such that a tool 135 extending through tube 134 into holding engagement with one of the notches 132 will be positioned directly beneath the axis of threaded bore 161 and therefore directly beneath the path along which air inlet line 64 extends into bore 161. Because of such placement of tube 134, a user can not readily insert the tool 135 into tube 134 while inlet line 64 is in place, and consequently he will find it necessary to disconnect line 64. This is considered a safety feature of the tool, in that it assures against accidental or unintentional starting of the motor while the pad is being disconnected and thus prevents injury which might occur as a result of such unintended operation. To facilitate disconnection of inlet line 64, that line may include a fitting **64*a* threadedly connected into bore 161 in block 61, a flexible air hose 64*b* connected to the air source, and a quick disconnect connector assembly 64*c* attached to the hose and detachably connectable to fitting 64*a***.

In using the tool, an operator grasps with one hand the upper handle cover 14 of the device, with the palm of his hand extending across the top of that handle and with his fingers and thumb extending downwardly at different sides of the peripheral portion 74. The square configuration of the handle assists a person in preventing rotation of the handle within his hand, without requiring that the handle be gripped very tightly. The palm of his hand presses downwardly on element 68 to press it downwardly against handle 14 and open valve 66 for admitting air to motor 18 and commencing rotation of the motor. The expansion of air within the motor tends to cool the motor parts to a very low temperature, but because of the insulating characteristics of the rubber of part 14 the hand of the user is protected against the low temperature of the motor.

As the rotor 34 of the motor turns, it drives carrier 29 rotatively about axis 20, so that the bearings 30 and 31 which are offset eccentricly with respect to that axis revolve or orbit about axis 20. The head 99 and carried pad 12 as well as the sandpaper attached thereto are forced to orbit with the bearings to perform an effective abrading operation on work surface 13. Because of the positioning of the counterweight 113 at the axially outer ends of bearings 30 and 31, and directly adjacent head 99, the counterweight is very closely coupled with respect to the orbiting parts and this closely coupled relationship prevents any substantial vibration of the tool in operation. The large bearing 31 is also located close to the planes of the counterweight and orbiting head 99 to take most of the forces exerted by the head, while the smaller bearing 30 assists in maintaining proper alignment of the parts but is not required to take as much of the lateral force as is bearing 31. The use of two bearings enables the overall assembly to take more thrust than would a single bearing.

The vacuum cleaner or other suction device 16 causes abraded particles to be drawn upwardly through pad 12 and into shroud 15, with an effective annular seal being provided between the pad and the shroud by conical seal element 129, and with the particles being drawn into and accumulated within bag 17. Besides thus confining the flow of suction air and abraded particles, the full metal shroud 15 protects a user from contact with and possible injury by the moving parts within the shroud.

When it is desired to remove the pad 12 from the device, this is effected in the previously discussed manner by detaching hose **64*b* at connector 64*c* and inserting a screw driver through tube 134 into engagement with one of the notches 123 in head 99 to retain the head against rotation while pad 12 is manually unscrewed from the head. If it becomes necessary to remove the bearings 30 and 31 from carrier 29, this may be attained by turning head 99 to a position in which its openings 123 are axially opposite screws 118, and then inserting an allen wrench through each of the openings 123 into the head of the corresponding screw 118 and turning the screws in a lefthand direction to screw them out of the mating bores 119 in carrier 29, with the heads of the screws forcing flange 100 of the head away from carrier 29** and thereby pulling the bearings out of the carrier.

While a certain specific embodiment of the present invention has been disclosed as typical, the invention is of course not limited to this particular form, but rather is applicable broadly to all such variations as fall within the scope of the appended claims.

I claim:

1. A portable abrading or polishing tool comprising:

a body adapted to be held by a user and carrying a motor;

a carrier driven rotatably about a first axis by said motor;

a head connected to said carrier for rotary movement relative thereto about a second axis offset laterally from said first axis and adapted to carry a pad at an axially outer side of the head for abrading or polishing a work surface;

bearing means connecting said head to the carrier for said relative rotary movement about said second axis;

a part attached to said carrier for rotation therewith; and threaded fastener means attaching said part to said carrier and including means engageable with said head for pulling it axially outwardly relative to the carrier by rotation of said fastener means.

2. A portable abrading or polishing tool as recited in claim 1, in which said part is a counterweight whose mass is unbalanced with respect to said first axis to at least partially counterbalance the head and pad.

3. A portable abrading or polishing tool as recited in claim 1, in which said part is constructed and positioned to block unintentional detachment of said bearing means from said carrier.

4. A portable abrading or polishing tool as recited in claim 1, in which said head is connected to said bearing means in a relation to pull the bearing means from said carrier as a result of movement of the head by said threaded fastener means.

5. A portable abrading or polishing tool as recited in claim 1, in which said head has a flange adjacent which said pad is received and has a shank projecting through said part and into said bearing means and said carrier, said part being received axially between the carrier and said flange of the head, said threaded fastener means including fasteners extending axially through said part and connected threadedly to said carrier and having heads confined between said part and said flange of said head to apply pulling force to the head, said head containing apertures for passing a tool therethrough into engagement with said fasteners to turn them.

6. A portable abrading or polishing tool comprising:

a body adapted to be held by a user and carrying a motor;

a carrier driven rotatably about a first axis by said motor;

a head connected to said carrier for rotary movement relative thereto about a second axis offset laterally from said first axis and adapted to carry a pad at an axially outer side of the head for abrading or polishing a work surface;

bearing means connecting said head to the carrier for said relative rotary movement about said second axis and having an axially inner end extending toward the motor and an axially outer end extending away from the motor and toward the location at which the pad is carried;

a counterweight structure connected to said carrier for rotation therewith about said first axis and having a portion whose mass is unbalanced with respect to said first axis in a relation at least partially counterbalancing the mass of said head and pad;

said unbalanced portion of the counterweight structure being located closer to said axially outer end of said bearing means than to said axially inner end thereof for close coupling with the pad to minimize vibration in use; and threaded fastener means attaching said counterweight structure to said carrier and including means engageable with said head for pulling the head axially outwardly relative to the carrier.

7. A portable abrading or polishing tool comprising:

a body adapted to be held by a user and carrying a motor;

a carrier driven rotatably about a first axis by said motor;

a head connected to said carrier for rotary movement relative thereto about a second axis offset laterally from said first axis and adapted to carry a pad at an axially outer side of the head for abrading or polishing a work surface;

bearing means connecting said head to the carrier for said relative rotary movement about said second axis and having an axially inner end extending toward the motor and an axially outer end extending away from the motor and toward the location at which the pad is carried;

a counterweight structure connected to said carrier for rotation therewith about said first axis and having a portion whose mass is unbalanced with respect to said first axis in a relation at least partially counterbalancing the mass of said head and pad;

said unbalanced portion of the counterweight structure being located closer to said axially outer end of said bearing means than to said axially inner end thereof for close coupling with the pad to minimize vibration in use;

said head being connected to said bearing means in a relation to pull the bearing means axially outwardly relative to said carrier; and threaded fastener means attaching said counterweight structure to said carrier and including means engageable with said head to exert force thereagainst for pulling the head and bearing means axially outwardly relative to the carrier.

8. A portable abrading or polishing tool comprising:

a body adapted to be held by a user and carrying a motor;

a carrier driven rotatably about a first axis by said motor and containing a recess;

a head connected to said carrier for rotary movement relative thereto about a second axis offset laterally from said first axis and having a flange and adapted to carry a pad at an axially outer side of the head for abrading or polishing a work surface;

bearing means connecting said head to the carrier for said relative rotary movement about said second axis;

a counterweight structure detachably connectable to said carrier for rotation therewith about said first axis and which is unbalanced with respect to said first axis to at least partially counterbalance the mass of said head and pad, and which is positioned to block detachment of said bearing means from said carrier;

said bearing means including a first relatively small diameter bearing having an outer race engaging a small diameter portion of said recess in the carrier and an inner race engaging a small diameter portion of said shank, and a second bearing of larger diameter located axially outwardly of said first bearing and having an outer race engaging a larger diameter portion of said recess and an inner race engaging a larger diameter portion of said shank; and threaded fasteners attaching said counterweight structure to said carrier and having heads confined axially between said counterweight structure and said flange of said head in a relation acting upon unscrewing rotation of said fasteners to exert a pulling force against said flange pulling said head and bearings away from the carrier;

said flange of the head containing openings for passing a tool through the openings into engagement with said fasteners to turn them in opposite directions.

9. A portable abrading or polishing tool as recited in claim 8, in which said flange of said head has an irregularity engageable with a tool to retain the head against rotation during separation of a pad therefrom, there being a shroud enclosing a space at the back of the head and containing an opening through which a tool is inserted into engagement with said irregularity in the head for retaining it against rotation.

10. A portable abrading or polishing tool comprising:

a body adapted to be held by a user and carrying a motor;

a part which is power actuable relative to the body by said motor to abrade or polish a work surface;

means forming a handle at the top of said body which is of generally square horizontal section, and a shroud extending downwardly from said handle toward said power actuated part;

said shroud having a side wall with a lower portion of circular horizontal cross-section near said part and an upper portion deformed to define downwardly flaring side walls interrupting the circular configuration of the side wall and giving said upper portion of the shroud a flaring approximately square horizontal cross section similar to that of said handle.

11. A portable abrading or polishing tool as recited in claim 10, in which said lower portion of said side wall of the shroud terminates in a downwardly flexible seal element engageable annularly with said part.

12. A portable tool comprising:

a body adapted to be held by a user and carrying a motor;

a head power actuated by said motor relative to said body;

a pad threadedly connected to said head at an axially outer side thereof for abrading or polishing a work surface;

a shroud extending essentially about the location of said head and enclosing a space at the back of the pad;

said head having an irregularity engageable with a tool in a relation retaining the head against rotation while the pad is unscrewed therefrom;

said shroud containing an opening for passing said tool therethrough from the exterior of the shroud to its interior and into engagement with said irregularity to hold said head against rotation;

said motor being air operated, and said body having an air inlet to which an air supply line is detachably connectable; and said opening in the shroud being so located that a tool inserted therethrough into engagement with said irregularity of the head is received approximately directly beneath an air supply line connected to said inlet and essentially directly between said inlet and said pad in a relation inducing a user to detach the air line before removing a pad from said head.

13. A portable abrading or polishing tool comprising:

a body adapted to be held by a user and carrying a motor;

a pad which is power actuated relative to said body by said motor;

a drive connection between said motor and said pad;

a shroud extending about said drive connection between the motor and pad and defining a compartment at the back of the pad for receiving particles abraded from a workpiece;

said shroud having an annular forward edge portion adapted to be received closely adjacent said pad and which flares progressively to an increased diameter as it approaches the pad; and an essentially annular resiliently deformable seal element carried by said flaring forward edge portion of said shroud and projecting therefrom into sealing engagement with a back side of said pad;

said seal element having a first essentially annular portion adjacent and secured to said flaring forward edge portion of the shroud and flaring in correspondence therewith, and having a second essentially annular portion projecting beyond said edge portion of the shroud and flaring at essentially the same angle as said edge portion of the shroud;

said seal element having a third annular portion beyond said second portion forming an edge which contacts said pad and is deformed thereby to flare at a greater angle than said edge portion of the shroud or either said first or second portions of the seal element and bears tightly against the pad by virtue of the resilience of said seal element to prevent leakage of abraded particles therepast.

14. A portable abrading or polishing tool as recited in claim 13, in which said seal element is formed of felt and is adhered to an inner flaring surface of said forward edge portion of the shroud.

15. A device comprising:

a rotor;

a housing containing a chamber within which the rotor turns and through which fluid flows as the rotor turns;

a shaft extending through a passage in the rotor and turning therewith;

said rotor having an inner surface containing an axially extending groove, and said shaft having an outer surface containing an axially extending groove opposite said groove of the rotor;

a key received partially within said groove of the rotor and partially within said groove of the shaft and keying the rotor and shaft rotatively together; and a spring received within one of said grooves at a location radially between a wall of said groove and said key and urging said groove wall and key in opposite radial directions to resist relative lateral movement of the rotor and shaft.

16. A device as recited in claim 15, in which said spring is a bowed leaf spring.

17. A device as recited in claim 15, in which said spring has ends turned to engage opposite ends of said key and locate the spring axially relative thereto.

18. A device as recited in claim 15, in which said spring is a leaf spring extending axially adjacent said key within said one groove and bowed away from the key to engage it at axially spaced locations and engage said groove wall at an intermediate location, said spring having ends turned to engage opposite ends of said key and locate the spring axially relative thereto.

19. A fluid driven rotary motor comprising:

a housing;

a rotor within said housing driven rotatively relative thereto by pressure fluid;

a shaft extending through a passage in the rotor and turning therewith;

said rotor having an inner surface containing an axially extending groove, and said shaft having an outer surface containing an axially extending groove opposite said groove of the rotor;

a key received partially within said groove of the rotor and partially within said groove of the shaft and keying the rotor and shaft together rotatively; and a spring received within one of said grooves at a location radially between a wall of said groove and said key and urging said groove wall and key in opposite radial directions to resist relative lateral movement of the rotor and shaft.

20. A motor as recited in claim 19, in which said key is a leaf spring having ends turned to engage opposite ends of the key and locate the spring axially relative thereto.

21. A motor as recited in claim 19, in which said spring is a leaf spring extending axially adjacent said key within said one groove and bowed away from the key to engage it at axially spaced locations and engage said groove wall at an intermediate location, said spring having ends turned to engage opposite ends of said key and locate the spring axially relative thereto.

22. A portable tool comprising a motor as recited in claim 21, in combination with a part power actuated by said shaft for abrading or polishing a work surface.

23. A portable tool comprising a motor as recited in claim 19, in combination with a part power actuated by said shaft for abrading or polishing a work surface.

* * * * *